US007223602B2

(12) United States Patent
Coleman et al.

(10) Patent No.: US 7,223,602 B2
(45) Date of Patent: May 29, 2007

(54) CONTINUOUS TRACER GENERATION METHOD

(76) Inventors: Dennis D. Coleman, 2612 Nottingham Ct. S., Champaign, IL (US) 61821; Rodney R. Ruch, 1821 Maynold Dr., Champaign, IL (US) 61822; Shiaoguo Chen, 109 W. McHenry, Urbana, IL (US) 61801; Massoud Rostam-Abadi, 1001 W. Charles St., Champaign, IL (US) 61821

( * ) Notice: Subject to any disclaimer, the term of this patent is extended or adjusted under 35 U.S.C. 154(b) by 136 days.

(21) Appl. No.: 10/235,327

(22) Filed: Sep. 4, 2002

(65) Prior Publication Data

US 2004/0072355 A1 Apr. 15, 2004

Related U.S. Application Data

(60) Provisional application No. 60/317,702, filed on Sep. 5, 2001.

(51) Int. Cl.
*G01N 33/24* (2006.01)

(52) U.S. Cl. ..... 436/27; 436/28; 436/29

(58) Field of Classification Search ..... 436/27–29
See application file for complete search history.

(56) References Cited

U.S. PATENT DOCUMENTS

| | | | | |
|---|---|---|---|---|
| 3,227,771 | A | | 1/1966 | Happel |
| 3,718,043 | A | * | 2/1973 | Fishman et al. ..... 73/861.05 |
| 3,880,621 | A | | 4/1975 | Schneider |
| 4,100,218 | A | | 7/1978 | Chen |
| 4,115,467 | A | | 9/1978 | Fowler |
| 4,551,154 | A | | 11/1985 | Malcosky |
| 4,690,689 | A | | 9/1987 | Malcosky |
| 4,709,577 | A | | 12/1987 | Thompson |
| 4,773,255 | A | | 9/1988 | Malcosky |
| 4,876,409 | A | | 10/1989 | Leyshon |
| 5,025,108 | A | | 6/1991 | Cameron |
| 5,113,032 | A | | 5/1992 | Cameron |
| 5,196,634 | A | | 3/1993 | Washecheck |
| 5,235,846 | A | | 8/1993 | Fanciullo |
| 5,245,099 | A | | 9/1993 | Mitariten |
| 5,270,016 | A | | 12/1993 | Alagy |
| 5,554,347 | A | | 9/1996 | Busson |
| 5,599,510 | A | | 2/1997 | Kaminsky |
| 5,712,217 | A | | 1/1998 | Choudhary |
| 5,744,015 | A | | 4/1998 | Mazanec |
| 5,817,904 | A | | 10/1998 | Vic |
| 5,862,512 | A | | 1/1999 | Voorhees |
| 5,900,521 | A | | 5/1999 | Park |
| 6,212,905 | B1 | | 4/2001 | Kuechler |

* cited by examiner

FOREIGN PATENT DOCUMENTS

| | | |
|---|---|---|
| WO | WO 96/10547 | 4/1996 |

*Primary Examiner*—Yelena G. Gakh

(57) ABSTRACT

The invention provides a method of online and on-site tracer generation for tagging natural gas stored in underground storage fields wherein feedstock is drawn from a feedstock source. The feedstock undergoes initial analysis to determine hydrocarbon levels. The feedstock then undergoes reaction to produce tracers such as ethylene, propylene, acetylene hydrogen and carbon monoxide. The feedstock is then analyzed to determine post reaction tracer concentration. The feedstock including generated tracers is then introduced back into the feedstock stream. Tracer levels in the pre-reaction or initial analysis of feedstock are compared with tracer levels in the post-reaction feedstock and the rate of flow of feedstock through the system is adjusted to achieve a predetermined level of tracer concentration. The level of tracer concentration will then be used to identify the particular natural gas charge in a storage field.

19 Claims, 2 Drawing Sheets

CONTINUOUS TRACER GENERATION METHOD

CROSS REFERENCE TO RELATED APPLICATION:

This application claims the benefit of PPA Application Ser. No. 60/317,702 with a filing date of Sep. 5, 2001.

FEDERALLY SPONSORED RESEARCH

Not applicable.

SEQUENCE LISTING OR PROGRAM

Not applicable.

BACKGROUND

This invention relates to an on-site, continuous method of tracer generation that can be utilized to tag natural gas. Natural gas is composed primarily of methane but contains lesser proportions of many compounds. Notable among those compounds are ethane, propane, and higher hydrocarbons. Although this invention finds application in tagging natural gas feedstock, it can be used to tag many other carbonaceous compounds including pure methane. Feedstock as used in this application encompasses natural gas, pure methane, the components of natural gas such as ethane, or any other carbonaceous substance in either liquid or gaseous form.

Most of the natural gas that is used in North America is produced either in the Gulf Coast region or in Northwestern Canada. Yet, most of the gas is used in the Northeast, the Midwest, and the northwestern United States. Therefore, large pipelines crisscross the country to transport natural gas from the producing areas to areas where the gas is used. Natural gas is frequently a byproduct of oil production. To produce oil, one often must also produce natural gas. Thus natural gas is produced year round in oil producing areas. However, there are also areas, which produce only natural gas, without oil. In those areas it is necessary to produce gas continuously, at a controlled rate, to maximize the productivity of a gas field. Further, if gas or oil is produced too rapidly, it can result in groundwater being drawn into the well and can seriously damage or even destroy a well.

Because gas is produced throughout the year but used primarily during the winter months, it is necessary to store natural gas until the months of peak usage. The most common method of storing natural gas is in underground storage reservoirs. Many of these storage reservoirs are areas where natural gas was produced years before. Because these reservoirs were demonstrated to have contained natural gas for millions of years, they provide a natural storage mechanism. Underground storage fields generally consist of porous rocks that are overlain by non-porous and non-permeable rocks. The porous rocks generally have the pore space filled with water. If one drills through the non-porous overlaying rock, or cap rock, one can pump gas into the pore space of the underlying reservoir unit, displacing the water.

There are over 350 such underground storage fields in North America in which gas is pumped underground during the warmer months of the year, and then withdrawn when additional gas is needed during cold periods. Some of these reservoirs are near the producing areas and others are near the end markets, sometimes in populated areas. Although underground storage reservoirs are designed to contain the gas, leakage of gas from these reservoirs does sometimes occur, resulting in a loss to the owner.

There are many scenarios in which identification of gas that has leaked or has been removed from a storage reservoir is critical. For example, if gas migrates to the surface it can enter shallow groundwater, used for drinking water supplies, and can even come to the surface, enter buildings, and result in explosions. Whenever natural gas is detected in the near-surface environment, over or near a gas storage reservoir, it becomes critical to determine if it is naturally occurring, native gas, or if it is gas leaking from the storage reservoir.

Another setting in which gas identification is critical is when there are producing oil and/or gas wells near gas storage fields. There are numerous situations throughout North America where this is the case. Although a gas company may attempt to define and describe the limits of the underground storage reservoir, the natural variations in the earth structure make it extremely difficult to be precise. Thus when gas is produced from a horizon above or adjacent to a gas storage field, the question frequent arises as to the ownership of that gas. If the gas occurs naturally within the rocks, it is the property of the producer. However, if the gas has migrated from a gas storage field, depending upon local laws, it may remain the property of the gas company. There have been numerous disputes throughout the country over the ownership of natural gas.

Thus, the ability to tag natural gas and the consequent capability of identifying the owner of the gas, is of significant value. To identify the source of natural gas, a tracer (like a fingerprint) may be added to the stored natural gas. By detecting the tracer contained in the gas under investigation, one could trace it back to its source. To qualify, the tracer has to satisfy several criteria: a). it must not normally exist in natural gas; b). it should not segregate from stored natural gas; c). it should not decompose rapidly or react with any other components; d). it should not be absorbed by the aquifer; and e). the detection limit should be low (that is the resolution should be high), so that the amount of added tracer can be low.

Natural gas within distribution pipelines in the country is tagged by adding an odorant. This is generally a sulfur bearing mercaptan. Because these mercaptans do no normally exist within natural gas, the presence of a mercaptan within the gas identifies it as pipeline gas. In gas storage reservoirs, mercaptans cannot be used effectively as tracers because, among other reasons, they are very reactive with the rocks. The gas may contain mercaptans when it is injected into a reservoir, but that mercaptan can quickly disappear and not remain with the gas. There are no existing methods of tagging gas prior to gas storage that are simple enough and inexpensive enough to be used on a routine basis as is done for pipeline gas distribution systems.

Many tracers have been tried, including ethylene, propylene, hydrogen, carbon monoxide, and others. Ethylene ($C_2H_4$) is one of the best tracers among all the tested tracers because it satisfies all the requirements of a good tracer. Pure ethylene generated offsite and shipped to the storage field has been used. Since the amount of natural gas to be stored is huge, in the range of billions of cubic feet, the use of pure ethylene is too expensive if it is used on a regular basis.

Furthermore, commercially available quantities of ethylene are either too large or too small and are thus not suited to continuous use in tagging natural gas storage fields. This invention produces ethylene and other potential tracers at a low cost and in quantities ideal for tagging natural gas with this tracer.

Although there have been several other tracers developed which can be utilized in gas reservoir studies for various purposes, there are none without serious limitation. For example, U.S. Pat. No. 4,551,154 to Malcosky describes an approach where the chemical sulfur hexafluoride and/or chloropentafluoroethane is injected into gas fields to determine ownership. Field tests have indicated that the two compounds were not fully recovered whereas as tracers such as ethylene, were fully recovered. The two tracers appeared to be less mobile than ethylene. Low permeability structures could restrict the migration of these compounds. Further, this system utilizes very expensive chemicals and specialized analytical equipment. Other authorities have determined that sulfur hexafluoride was not deemed to be a suitable tracer in this application due to its instability and reactivity under long-term field conditions and its differing dispersion behavior relative to methane, while yet other authorities maintain that sulfur hexafluoride may have toxicity problems that may preclude its extensive utilization.

OBJECTS AND ADVANTAGES

The invention uses materials to generate the tracer that are all readily available and inexpensive, i.e., the primary components of natural gas itself. Most of the processes that are used to generate ethylene or propylene from natural gas use only heat (pyrolysis), or at most, oxygen or water as the other reactant. Oxygen is of course readily available from air. Therefore, the invention does not involve transporting reactants from some great distance and is not hindered by commercially available quantities. With the use of the proper reactor, the only other thing needed to generate a tracer from natural gas is energy, which can even be supplied by combustion of a small amount of the natural gas itself.

Pure ethylene can be used as a tracer, but because the amount of natural gas to be stored is huge, the use of pure ethylene is too expensive if it is used on regular basis. A new technology, which could produce ethylene and other potential tracers at a low cost is needed. The invention described herein, provides a method whereby tracer can be added to natural gas continuously, and at very low cost. All current methods of adding tracers to natural gas involve transporting pure or manufactured products to the point where they can be introduced into the gas line. This invention allows on-site generation of tracer.

The process generates compounds that are not normal constituents of natural gas and that have been previously verified as usable tracers within the gas storage industry. More specific tracers can be generated by utilizing water that is enriched in deuterium, tritium, oxygen-18, or other isotopic species. The process, being either pyrolysis or the catalytic reaction of air, carbon dioxide or water with natural gas, is such that the necessary, commercially available equipment can be made transportable for easy movement from one site to another.

The cost of this process is so low that it will be possible to routinely and continuously tag all of the gas injected into a storage reservoir eliminating many of the problems associated with existing tracer technology. Currently there are no tracers for gas that is stored in underground reservoirs that can be economically utilized on a long term, continuous basis.

The analytical equipment and methods necessary for analysis of the basic tracers are those present in most laboratories capable of carrying out routine analysis of natural gas, further adding to the economic benefits of this process.

SUMMARY

This invention is based on the discovery of a method of utilizing a feedstock, itself, to generate identifying tracers through either a pyrolytic process or a reaction process in the presence of certain catalysts. Ethylene is the primary tracer generated, however, other tracers such as propylene, acetylene, $H_2$, CO, are also generated in the reaction process or other tracers such as deuterated water and isotopically labeled hydrocarbons can be introduced and can serve singly as tracers.

Accordingly, these tracers can be used in combination to produce readily identifiable tracer mixtures that serve as unique markers. The invention not only creates the tracers but creates the tracers in predetermined concentrations. Feedstock tagged with predetermined concentrations can also serve as unique identifiers.

A further aspect of the invention is the on-site capability of tracer generation. This allows entire storage fields to be continuously tagged at the time the fields are initially filled or injected eliminating the need to acquire tracer in commercially reasonable amounts and transporting those tracers to the field injection well.

Figure 1:
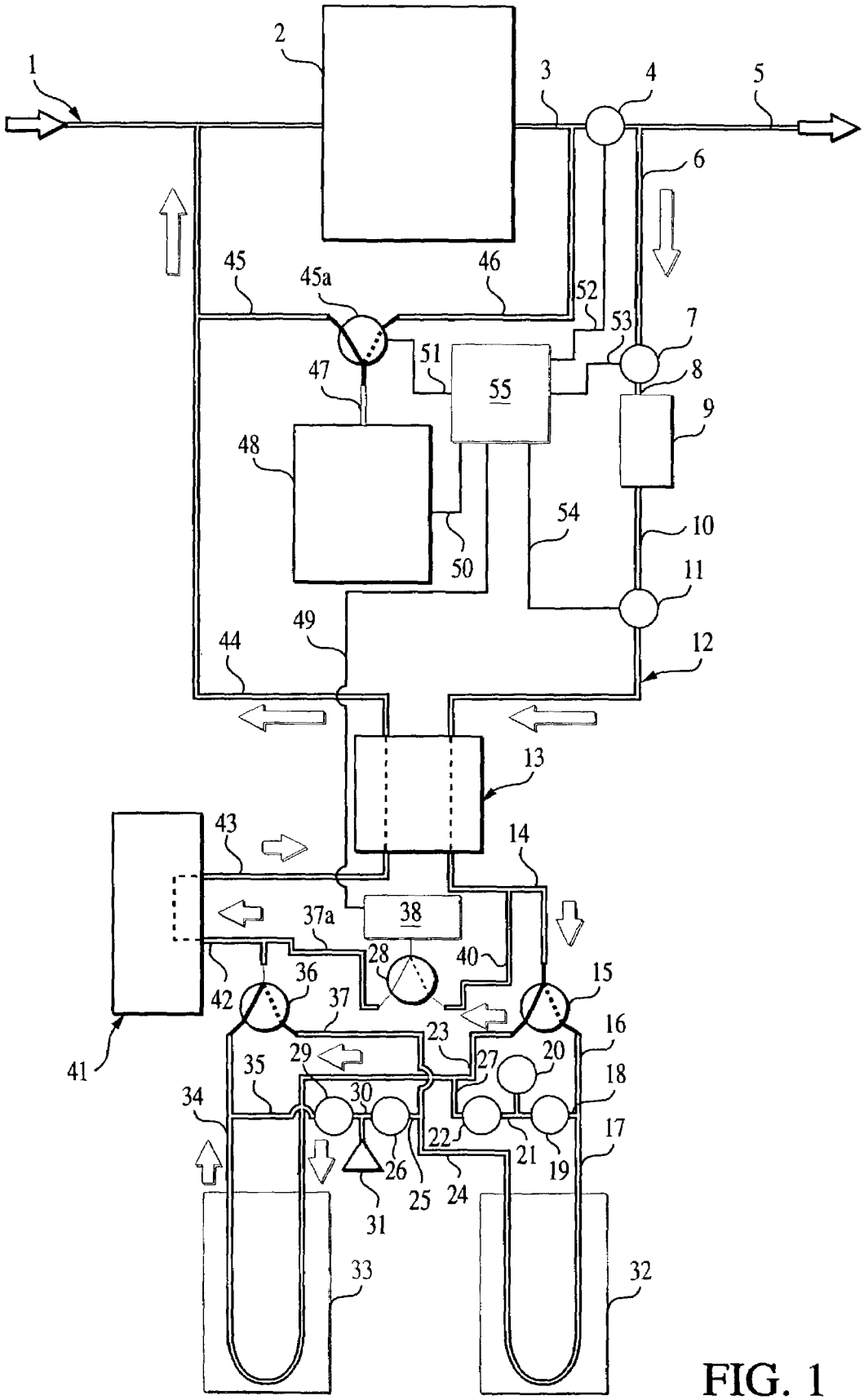
FIG. 1 is a schematic diagram of the process whereby ethylene tracer and other desirable tracers are generated on-site and online and then reintroduced into the feedstock to be stored.

REFERENCE NUMERALS first line 1
storage field compressor 2
choke valve 2*a*
second line 3
first flow meter 4
twenty sixth line 5
third line 6
flow control and pressure reduction valve 7
fourth line 8
collector 9
fifth line 10
second flow meter 11
sixth line 12
heat exchanger 13
seventh line 14
first three-way valve 15
sixteenth line 15
seventeenth line 16
twenty second line 17
twenty seventh line 18
first valve 19
nineteenth line 21 second valve 22
eighth line 23
eighteenth line 24
twenty third line 25
third valve 26
twentieth line 27
fourth three-way valve 28
fourth valve 29
twenty eighth line 30
first primary reactor 32
second primary reactor 33
ninth line 34
twenty-first line 35
second three-way valve 36
twenty fifth line 37
reactant source 38
twenty third line 40
secondary reactor 41
tenth line 42
eleventh line 43
twelfth line 44
thirteenth line 45
third three-way valve **45*a***
fifteenth line 46
twenty ninth line **46*a***
fourteenth line 47
analyzer 48
fifth data line 49
fourth data line 50
sixth data line 51
first data line 52
second data line 53
third data line 54
computer control 55

DETAILED DESCRIPTION

This invention utilizes several processes to generate ethylene tracer and other secondary tracers. The processes are the oxidative coupling of methane (OCM) in natural gas process and pyrolysis of ethane, a constituent of natural gas. For pyrolysis, both atmospheric pressure and high-pressure conditions were studied. These two technologies allow a cost-effective on-site and online process for underground gas storage use on a regular basis. Furthermore, the process may also employ oxidative pyrolysis, chloropyrolysis, steam and/or carbon dioxide reforming and partial oxidation of natural gas and natural gas conversion using electric arc or plasma to generate such tracers as acetylene, carbon monoxide, hydrogen, and isotopically labeled hydrocarbons An experimental reaction system was designed for the OCM and pyrolysis experiments. Separate sources for $CH_4$, natural gas and air were fed into a central line through individual flow meters. The central line then led to a heat source surrounding the reactor. In the atmospheric pressure experiments, a quartz tube (7 mm ID) was used as the reactor with a heating zone approximately 30 cm long. In the pressurized pyrolysis, a stainless steel tube (0.04 inch ID and ¼-16 inch OD) was used. Here the heating zone was also 30 cm long. In the latter system, a pressure release valve was used to keep the system pressure at 850 psi. Actual pipeline gas was used but pure methane was tested for comparison purposes. Table 1 illustrates the composition of methane and the pipeline gas used.

TABLE 1

| | Ar | $CO_2$ | $N_2$ | CO | C1 | C2 | $C_2H_4$ | C3 | $C_4$+ |
|---|---|---|---|---|---|---|---|---|---|
| Methane Gas | 0.06 | 0 | 0.06 | 0 | 99.86 | 0.017 | 0 | 0 | 0 |
| Pipeline Gas | 0.08 | 0.45 | 0.89 | 0 | 94.55 | 3.71 | 0 | 0.25 | 0.081 |

EXAMPLE 1

In the OCM process, methane, the major component of natural gas, is used as feedstock to generate higher hydrocarbon compounds. The simplified chemistry of OCM process is as follows : $2CH_4+O_2 \Longrightarrow C_2H_4+2H_2O$. The oxygen can be from air or pure oxygen gas. For the purposes of the invention, air is easier and cheaper to obtain. The OCM process will utilize a catalyst that results in the production of ethylene as one of the major $C_2$ products when the reaction is properly controlled. Since the OCM reaction is very fast and strongly exothermic, only low oxygen concentrations can be applied. Thus the concentration of ethylene in the product stream is usually low. It should be noted that low concentration of product, added to the high cost of separating ethylene from the product stream are factors that hinders the commercialization of OCM process for ethylene production, but are not factors for the on-site production of tracer.

One catalyst studied was $Mn/Na_2WO_4/SiO_2$. Table 2 illustrates the yield of ethylene in one sample of pure methane and one sample of natural gas (NG), both in the presence of the $Mn/Na_2WO_4/SiO_2$ (LICP-1) catalyst.

TABLE 2

| Gas | Catalyst | T ° C. | Flow Rate ml/(min.g) | Ratio $CH_4$:Air | $C_2H_4$ concentration % | $C_2H_6$ concentration % |
|---|---|---|---|---|---|---|
| $CH_4$ | LICP-1 | 780 | 843 | 2.5:1 | 0.05 | 0.24 |
| NG | None | 780 | 125 | 0% | 0.63 | 3.1 |
| NG | LICP-1 | 780 | 267 | 2.5:1 | 3.47 | 0.39 |

These test results show the yield of ethylene from natural gas in the catalytic process increased by more than two percent as compared to that observed for natural gas in the non-catalytic process.

EXAMPLE 2

Ethane pyrolysis is a well-established process. However, reaction kinetics have been studied primarily with pure ethane (with steam) pyrolysis and at atmospheric pressure. In order to obtain more realistic data, pyrolysis of real pipeline gas (NG) was conducted at a total pressure of 1 atmosphere. Table 3 illustrates the results of ethylene production at standard pressures using pipeline gas.

TABLE 3

| P psi | T ° C. | Flow Rate ml/min | Space velocity 1/hr | $C_2H_4$ Concentration % | $C_2H_6$ Concentration % |
|---|---|---|---|---|---|
| 14.7 | 900 | 35 | 558 | 2.4 | 0.18 |
| 14.7 | 900 | 70 | 1117 | 2.61 | 0.32 |
| 14.7 | 900 | 105 | 1675 | 2.62 | 0.49 |
| 14.7 | 900 | 140 | 2234 | 2.56 | 0.65 |
| 14.7 | 900 | 175 | 2792 | 2.47 | 0.79 |
| 14.7 | 850 | 35 | 558 | 2.63 | 0.46 |

TABLE 3-continued

| P psi | T ° C. | Flow Rate ml/min | Space velocity 1/hr | $C_2H_4$ Concentration % | $C_2H_6$ Concentration % |
|---|---|---|---|---|---|
| 14.7 | 850 | 70 | 1117 | 2.42 | 0.88 |
| 14.7 | 850 | 105 | 1675 | 2.17 | 1.25 |
| 14.7 | 850 | 140 | 2234 | 1.96 | 1.53 |

The results showed that at 900° C. about 70% of the ethane in the pipeline gas is converted to ethylene. A small amount of acetylene is also formed, which can also be used as a tracer. The results are in agreement with the results from theoretical prediction. It can be seen in Table 3 that, as predicted by thermodynamics, higher temperature favors the ethane pyrolysis reaction.

EXAMPLE 3

Since pipeline gases are usually pressurized and the pressure of gas to be stored underground is even higher, it would be desirable to convert ethane at an elevated pressure, especially at or above the transportation pressure of pipeline gas. Most of the pipeline gas has a pressure range from 600 psi to 850 psi, and 850 psi was chosen as the test pressure. Table 4 illustrates the results of ethylene production at elevated pressures similar to those seen in natural gas pipelines.

TABLE 4

| P psi | T ° C. | Flow Rate ml/min | Space Velocity 1/hr | $C_2H_4$ Concentration % | $C_2H_6$ Concentration % | $C_3H_6$ Concentration % |
|---|---|---|---|---|---|---|
| 850 | 700 | 465 | $1.18*10^5$ | 0.03 | 3.50 | 0.01 |
| 850 | 750 | 466 | $1.19*10^5$ | 0.17 | 3.39 | 0.03 |
| 850 | 800 | 470 | $1.20*10^5$ | 0.60 | 2.89 | 0.09 |
| 850 | 800 | 819.7 | $2.09*10^5$ | 0.34 | 3.23 | 0.05 |
| 850 | 800 | 235 | $5.98*10^4$ | 0.81 | 2.61 | 0.13 |
| 850 | 850 | 457 | $1.16*10^5$ | 1.22 | 2.14 | 0.19 |
| 850 | 850 | 787 | $2.00*10^5$ | 0.92 | 2.63 | 0.13 |
| 850 | 850 | 229 | $5.83*10^4$ | 0.82 | 1.83 | 0.17 |

The ethylene concentration in the product stream produced at high pressure was lower than the ethylene concentration produced in the atmospheric system. This can be explained by the effect of partial pressure of ethane in the system. Total pressure adversely affects the equilibrium constant for ethane conversion. Increasing pressure decreases the ethylene concentration. At 850° C. and at 850 psi, about 30% of ethane that existed in pipeline natural gas is converted to ethylene, compared with 70% for the atmospheric process. This is in agreement with the thermodynamics. At 850° C., and under optimized residence time, the maximum ethylene concentration is about 30% of the ethane concentration in the feedstock. In this case ethane concentration in feedstock is around 3.6 and the highest ethylene concentration in the test is 1.2%. Ethane partial pressure in the pressurized system is around 3.6%*850=30 psi, which is approximately 2 atm and is close to the pressure used in commercial processes. It should be noted as illustrated in the last column, that propylene is also generated and this too can serve as a tracer. Controlling the ethylene/propylene ratio provides a way of generating different "signatures" in different gas streams. It is interesting to note that the optimized conditions for maximizing ethylene concentration could be very close to the optimization conditions for maximizing propylene concentration.

All mechanisms tested generated ethylene in sufficient quantities to allow a tracer concentration of 50 to 100 parts per million to be generated in the post pyrolysis feedstock to be introduced into the feedstock stream designated for injection.

Additional tracers can be generated post-pyrolysis by reforming reactions using water and/or carbon dioxide or partial oxidation using air. Reforming reactions involving the addition of heat, would follow the general formula $2H_2O+C_2H_6 = 2CO+5H_2$ or $2CO_2+C_2H_6 = 4CO+3H_2$. Oxidation reactions would follow the general formula $O_2+C_2H_6 = 2CO+3H_2$. CO is not present in natural gas and can provide additional tracer functions.

De-coking can also be accomplished by the addition of water, carbon dioxide and air, pre-pyrolysis. The basic reactions would be as follows: $H_2O+C = CO+H_2$, or $CO_2+C = 2CO$, and finally $O_2+C = 2CO$.

Turning to FIG. 1, it can be seen that carbonaceous feedstock, for example natural gas, is introduced into the system through first line 1, in practice, a pipeline delivering natural gas to a storage field. Pressures in Line I will usually be in the neighborhood of 600 to 850 psi. First line 1 enters and is fluidly connected storage field compressor 2 where the pressure of the natural gas is increased to allow injection into a storage field reservoir. Pressures here may exceed 1750 psi.

Drawing feedstock from the feedstock source is accomplished by second line 3 that exits the storage field compressor and enters first flow meter 4 that measures the flow rate within the feedstock source. A transducer in flow meter 4 will transmit data, through first data line 52 to computer control 55 indicating the volume of feedstock passing through flow meter 4. Twenty-sixth line 5 exist flow meter 4 and enters the storage field. Third line 6 establishes fluid communication with the feedstock source and removes feedstock under pressure to flow control and pressure reduction valve 7, also fluidly connected to third line 6. Regulating flow and pressure thorough the fluid communication is flow control and pressure reduction valve 7. Valve 7 is controlled through second data line 53, which is connected to the computer control 55 and controls the quantity and pressure of the gas passing valve 7. The flow control and pressure reduction valve also will serve to reduce the variations in pressure, which may be induced by the storage field compressor and is controlled by computer control 55, again through second data line 53. Fourth line 8 then delivers feedstock to a collector 9 that cools the feedstock within the fluid communication. Collector 9 is designed to cryogenically precipitate certain classes of compounds such as butanes and pentanes, which contribute to coking later in the process. Fifth line 10 then exits the collector 9 and enters second flow meter 11. Second flow meter 11 measures the flow rate within the fluid communication at this stage. Second flow meter 11 contains a transducer, which transmits data, through third data line 54, to computer control 55, reporting the effects, on the feedstock, of flow control and pressure reduction valve 7. Sixth line 12 exits second flow meter 11 and enters heat exchanger 13. Heat exchanger 13 utilizes heat from downstream feedstock exiting from a reaction zone to allow preheating of the feedstock within the fluid communication which then enters the reaction zone of the reactors. Preheating in heat exchanger 13 saves energy and reduces the time necessary for the feedstock to remain within the reaction zone. Seventh line 14 exits heat exchanger 13 and enters first three-way valve 15. First three-way valve 15 directs the feedstock to either first primary reactor 32 or second primary reactor 33. In FIG. 1, first three-way valve 15 is diverting feedstock into second primary reactor 33 through eighth line 23 and into second primary reactor 33 where ethane pyrolysis or oxidative coupling is accomplished generating tracers within either the non-catalytic reaction zone or catalytic reaction zone as the case may be. Ninth line 34 exits second primary reactor 33 to second three-way valve 36. Tenth line 42 exits second three-way valve 36 and enters secondary reactor 41. Secondary reactor 41 would allow introduction of reactants into the stream and the production of secondary tracers. Eleventh line 43 exits secondary reactor 41 and enters heat exchanger 13 where heat is transmitted to feedstock entering through sixth line 12 raising the temperature of the feedstock that has not yet undergone reaction. Twelfth line 44 exits the heat exchanger and reintroduces the product gas into first line 1 and the feedstock source The post reaction analysis of the feedstock to determine trace levels is accomplished when thirteenth line 45 diverts a sample of feedstock from twelfth line 44 into third three-way valve 45*a*. Third three-way valve 45*a* then diverts feedstock in thirteenth line 45 into fourteenth line 47 and consequently into analyzer 48. Thus a fluid communication with post reaction feedstock is established. Introduction of the post reaction feedstock into the analyzer is accomplished allowing the measure of tracer levels. Analyzer 48, in this configuration, would be a gas analyzer such as a gas chromatograph, mass spectrometer, infrared spectroscope or other analyzer of similar capability. Analyzer 48 measures the level of tracer and transmits that information to computer control 55 through fourth data line 50. Data establishing the desired level of tracer concentration is introduced into the computer control 55 that has been programmed to adjust the system to achieve a predetermined desired tracer concentration. Computer control 55 consequently transmits flow and pressure regulating data within the fluid communication and adjusts the flow rate through flow control and pressure reduction valve 7 by transmitting data instructions through second data line 53. Adjusting the rate of draw of feedstock into the system is initiated if the analysis reveals that tracer levels are falling, computer control 55 then increases the amount of feedstock flowing through flow control and pressure reduction valve 7 and, consequently, a greater amount of tracer is generated bringing the tracer level up to the desired value. Three-way valve 45*a* also will allow a sample to be taken through fifteenth line 46 of the feedstock in second line 3 emanating from the storage field compressor. Thus a fluid communication with pre reaction feedstock is established. Introduction of the pre reaction feedstock into the analyzer is accomplished allowing the measure of tracer levels at that point in the system. Tracer levels within the post reaction feedstock and pre reaction feedstock are compared with the predetermined desired tracer concentration. Software that could be utilized could be programs such as "The Gas Flow Control System" by Zin Technologies or the combined use of "Lookout" by National Instruments and "TLC Momentum from Modocom Instruments.

Sixth dataline 51 connects third three-way valve 45*a* and computer control 55. Computer control 55 will cause three-way valve 45*a* to continuously and alternately draw samples from fourteenth line 45 and fifteenth line 46. As stated, fourteenth line 45 draws product gas from first line 1, however, fifteenth line 46 will draw pre pyrolysis feedstock from second line 3. Feedstock from second line 3 is continuously analyzed to determine the level of tracer that has been introduced through fourteenth line 45 into first line 1.

Introducing the feedstock into a reaction zone is accomplished by first three-way valve 15 being set to direct the feedstock flow from seventh line 14 into seventeenth line 16 and into first primary reactor 32. After remaining in the reaction zone for a predetermined period of time, where the tracer is generated. Feedstock then exits through eighteenth line 24 and into second three-way valve 36, which is set to accept feedstock from eighteenth line 24 passing it on through to tenth line 42. In this way, the reaction zone may be shifted from second primary reactor 33 to first primary reactor 32, thereby taking second primary reactor offline to allow decoking. In this manner, second primary reactor 33 and first primary reactor 32 may be alternately taken off line for maintenance, component replacement and decoking. Decoking of the second primary reactor may be accomplished by adjusting first three-way valve 15 and second three-way valve 36 to place first primary reactor 32 online. Then, first valve 19 is closed and second valve 22 is opened. This will allow compressed air from compressed air source 20 to flow into nineteenth line 21 and subsequently into twentieth line 27 and then into second primary reactor 33 allowing coke burn off. At the same time third valve 26 is closed and fourth valve 29 is open. Then the decoking product stream exits second primary reactor 33 via ninth line 34, then enters twenty-first line 35, then into through fourth valve 29, into twenty eighth line 30 and exits the system through vent 31.

Alternatively, first three-way valve 15 and second three-way valve 36 may be set to allow the redirecting of the feedstock into second primary reactor 33. Second valve 22 is closed and first valve 19 is open. Thus, allowing compressed air to pass into nineteenth line 21 and on into twenty second line 17, then into first primary reactor 32. The combustion stream from decoking then exits first primary reactor 32 via eighteenth line 24, then enters twenty third line 25 passing through open third valve 26 entering line 30, then closed fourth valve 29 will direct the combustion product to vent outside the system through vent 31.

In order to facilitate decoking or to generate further secondary tracers, other reactants may be introduced under pressure through reactant source 38. Reactant source 38 and the consequent introduction of reactants, is activated by computer control 55 through fifth data line 49. Should decoking be desired, compounds such as water, carbon dioxide and air may be introduced. In this case, those compounds would exit reactant source 38 into fourth three-way valve 28, which will be sent to empty into twenty third line 40, which will then transmit the decoking compounds through seventh line 14 into either the first primary reactor 32 or the second primary reactor 33. Alternatively, fourth three-way valve 28 could be configured to introduce reactants from reactant source 38 into twenty fifth line 37, which will then be transferred into secondary reactor 41.

Figure 2:
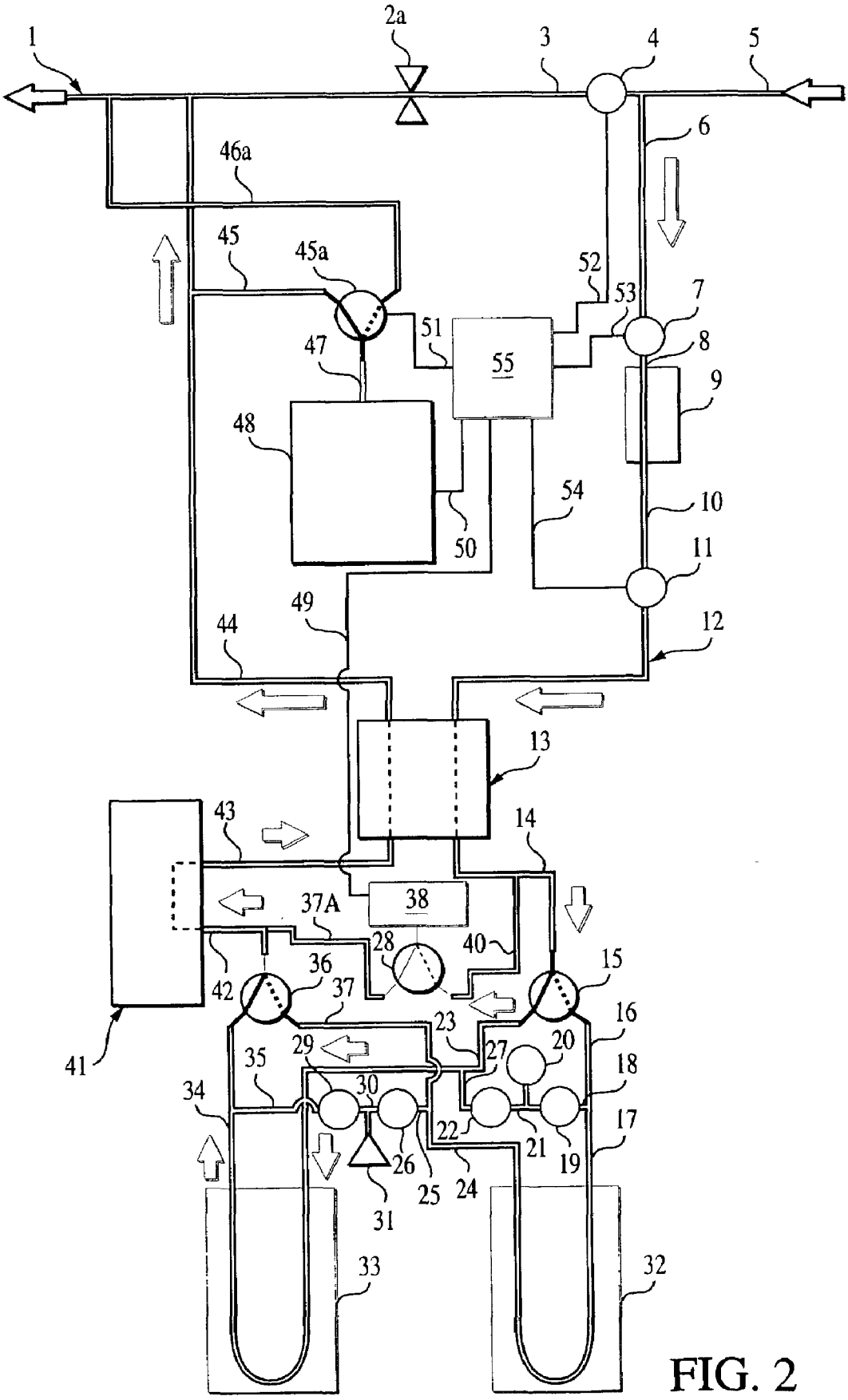
FIG. 2 is a schematic diagram of an alternative embodiment of the process whereby the pressure differential means is a choke valve.

An alternative embodiment would be the use of a mechanism to generate pressure differential such as a separate compressor, choke, or valve in place of the storage field compressor, to cause flow through the reactor. As shown in FIG. 2, if a choke or valve is used then the direction of flow in first line I and twenty sixth line 5 is reversed from that shown in FIG. 1. In this embodiment twenty ninth line 46*a* takes the place of fifteenth line 46 and connects to first line 1 down flow from choke valve 2*a*. If this embodiment is used it would find application, for example, on an individual injection well which would be located down flow from choke valve 2*a* as compared with the storage field being down flow from the pressure differential means 2 in FIG. 1. Up flow from the choke valve 2*a* would be the storage field compressor or feed line. Thus tracers can be injected at several points to study the characteristics of a storage field.

Although the description above contains many detailed specifics, they should be viewed as illustrative and not as limiting the scope of the invention which should be determined by the claims and their legal equivalents.

What is claimed is:

1. A method for tagging gaseous or liquid carbonaceous feedstock with durable tracers of predetermined concentrations generated from existing components of the feedstock, comprising:

a. withdrawing a carbonaceous feedstock sample from a carbonaceous feedstock source, b. measuring a flow rate of the carbonaceous feedstock sample flow, c. analyzing said carbonaceous feedstock sample to determine initial tracer concentration, d. introducing said carbonaceous feedstock sample into a catalytic or non-catalytic reaction zone, e. generating more tracers within said catalytic or non-catalytic reaction zone from said carbonaceous feedstock sample, f. analyzing said carbonaceous feedstock sample to determine added tracer concentration, g. reintroducing said carbonaceous feedstock sample into said carbonaceous feedstock source, h. adjusting the rate of withdrawing said carbonaceous feedstock sample from said carbonaceous feedstock source on the basis of measured initial and added tracer concentrations, thereby regulating the amount of carbonaceous feedstock sample introduced into said catalytic or non-catalytic reaction zone and thereby regulating the concentration of said tracers in said carbonaceous feedstock source to a predetermined level, using computer controlled feedback.

2. The method of claim 1 wherein drawing said carbonaceous feedstock sample from a carbonaceous feedstock source further comprises, a. cooling said carbonaceous feedstock sample prior to introducing said carbonaceous feedstock sample into said catalytic or non-catalytic reaction zone whereby undesired components known to induce coking are precipitated,

3. The method of claim 1 wherein said introducing said carbonaceous feedstock sample into a catalytic or non-catalytic reaction zone further comprises preheating said carbonaceous feedstock sample.

4. The method of claim 1 wherein generating said tracers within said non-catalytic reaction zone will result in tracers from the following group, ethylene, propylene, acetylene, hydrogen and carbon monoxide.

5. The method of claim 1 wherein said catalytic reaction zone is charged with a commercially available metal or metal oxide catalyst.

6. The method of claim 1 wherein generating said tracers within said catalytic reaction zone will result in tracers from the following group, ethylene, propylene, acetylene, hydrogen and carbon monoxide.

7. The method of claim 1 wherein said analyzing said carbonaceous feedstock sample to determine added tracer concentration further comprises, comparing tracer levels in pre-reaction cycle carbonaceous feedstock source and post-reaction cycle carbonaceous feedstock sample.

8. The method of claim 7 wherein said adjusting the rate of withdrawing said carbonaceous feedstock sample from said carbonaceous feedstock source further comprises, a. introducing a desired level of tracer concentration into a computer control, b. transmitting measured flow rate data within said carbonaceous feedstock source to said computer control, c. transmitting flow and pressure regulating data from said computer control to regulate flow and pressure within said fluidly connected system whereby the flow of said carbonaceous feedstock sample within said fluidly connected system and into said reaction, zone may be increased or decreased such that the predetermined level of tracer concentration entered into said computer control can be achieved.

d. transmitting measured flow rate data within said fluidly connected system to said computer control.

9. The method of claim 1 wherein introducing said carbonaceous feedstock sample into the catalytic or non-catalytic reaction zone further comprises, a. introducing said carbonaceous feedstock sample into a catalytic or non-catalytic first reaction zone, b. redirecting said carbonaceous feedstock sample into a second catalytic or non-catalytic reaction zone where tracer generation can continue and whereby maintenance may be preformed on said first catalytic or non-catalytic reaction zone, c. redirecting said carbonaceous feedstock sample into said first catalytic or non-catalytic reaction zone whereby maintenance may be performed on said second catalytic or non-catalytic reaction zone.

10. The method of claim 1 further comprising, a. introducing reactants, under computer control, whereby secondary tracers may be generated, b. introducing, under computer control, de-coking reactants, c. introducing, under computer control, post reaction secondary tracers.

11. The method of claim 10 wherein said reactants introduced post reaction, are selected from a group comprised of water and carbon dioxide whereby through a reforming reaction, secondary tracers are generated.

12. The method of claim 11 wherein said secondary tracers generated are carbon monoxide and hydrogen.

13. The method of claim 10 wherein said reactants introduced post reaction are selected from a group comprised of air or oxygen whereby through oxidation reactions, secondary tracers are generated.

14. The method of claim 13 wherein said generated secondary tracers are carbon monoxide and hydrogen.

15. The method of claim 10 wherein said de-coking reactants introduced pre-reaction, are selected from a group comprised of water, air and carbon dioxide.

16. The method of claim 10 wherein said secondary tracers are generated by the introduction of deuterated water to create isotopically labeled hydrocarbons drawn from a group comprised of deuterium enriched ethane, methane and propane.

17. The method of claim 1 wherein the reaction in said reaction zone is catalytic oxidative coupling of methane, oxidative pyrolysis, steam and/or carbon dioxide reforming, partial oxidation of natural gas and natural gas conversion using electric arc or plasma, and pyrolysis.

18. The method of claim 1 where withdrawing a carbonaceous feedstock sample is by means of a field compressor producing a pressure differential.

19. The method of claim 1 where withdrawing a carbonaceous feedstock sample is by means of a separate compressor, choke or valve producing a pressure differential.

* * * * *